US005881830A

United States Patent [19]

Cooley

[11] Patent Number: 5,881,830

[45] Date of Patent: Mar. 16, 1999

[54] SUPERABRASIVE DRILL BIT CUTTING ELEMENT WITH BUTTRESS-SUPPORTED PLANAR CHAMFER

[75] Inventor: Craig H. Cooley, Bountiful, Utah

[73] Assignee: Baker Hughes Incorporated, Houston, Tex.

[21] Appl. No.: 800,874

[22] Filed: Feb. 14, 1997

[51] Int. Cl.[6] ..... E21B 10/36

[52] U.S. Cl. ..... 175/428; 175/432

[58] Field of Search ..... 175/412, 428, 175/429, 432, 331

[56] References Cited

U.S. PATENT DOCUMENTS

| | | | |
|---|---|---|---|
| Re. 32,036 | 11/1985 | Dennis | 175/429 |
| 3,745,623 | 7/1973 | Wentorf, Jr. et al. . | |
| 4,109,737 | 8/1978 | Bovenkerk . | |
| 4,323,130 | 4/1982 | Dennis . | |
| 4,381,825 | 5/1983 | Radtke . | |
| 4,396,077 | 8/1983 | Radtke . | |
| 4,410,054 | 10/1983 | Nagel et al. . | |
| 4,442,909 | 4/1984 | Radtke . | |
| 4,478,298 | 10/1984 | Hake et al. . | |
| 4,494,618 | 1/1985 | Radtke . | |
| 4,498,549 | 2/1985 | Jürgens . | |
| 4,499,795 | 2/1985 | Radtke . | |
| 4,499,958 | 2/1985 | Radtke et al. . | |
| 4,545,441 | 10/1985 | Williamson . | |
| 4,592,433 | 6/1986 | Dennis . | |
| 4,593,777 | 6/1986 | Barr . | |
| 4,607,711 | 8/1986 | Zijsling . | |
| 4,632,196 | 12/1986 | Dennis . | |
| 4,690,691 | 9/1987 | Komanduri . | |
| 4,702,649 | 10/1987 | Komanduri . | |
| 4,705,123 | 11/1987 | Dennis . | |
| 4,714,385 | 12/1987 | Komanduri . | |
| 4,724,913 | 2/1988 | Morris . | |
| 4,729,440 | 3/1988 | Hall . | |
| 4,764,434 | 8/1988 | Aronsson et al. . | |
| 4,784,023 | 11/1988 | Dennis . | |
| 4,792,001 | 12/1988 | Zijsling . | |
| 4,797,138 | 1/1989 | Komanduri . | |
| 4,858,707 | 8/1989 | Jones et al. . | |
| 4,869,330 | 9/1989 | Tibbitts . | |
| 4,872,520 | 10/1989 | Nelson . | |
| 4,919,013 | 4/1990 | Smith et al. . | |
| 4,926,950 | 5/1990 | Zijsling . | |
| 4,976,324 | 12/1990 | Tibbitts . | |
| 4,984,642 | 1/1991 | Renard et al. . | |
| 4,987,800 | 1/1991 | Gasan et al. . | |
| 5,011,515 | 4/1991 | Frushour . | |
| 5,016,718 | 5/1991 | Tandberg . | |
| 5,027,912 | 7/1991 | Juergens . | |
| 5,045,092 | 9/1991 | Keshavan . | |

(List continued on next page.)

FOREIGN PATENT DOCUMENTS

| | | |
|---|---|---|
| 2 294 069 | 4/1996 | United Kingdom . |
| 2299 111 | 9/1996 | United Kingdom . |
| WO 97/30263 | 8/1997 | WIPO . |

OTHER PUBLICATIONS

Search Report, dated 16 Jul. 1998 (2 pages).

*Primary Examiner*—Roger Schoeppel
*Attorney, Agent, or Firm*—Trask, Britt & Rossa

[57] ABSTRACT

Superabrasive cutting elements for use in drilling subterranean formations, and drill bits so equipped. The cutting element includes a superabrasive table between about 0.090 inch and 0.120 inch thickness, mounted to a supporting cemented carbide substrate. The superabrasive table includes a two-dimensional cutting face with a first surface transverse to the longitudinal axis of the cutter and a second, planar engagement surface or buttress plane oriented at a small, acute angle with respect to the first surface and having a cutting edge along at least a portion of its periphery adjacent the lateral periphery of the cutter. A tapered side surface on the superabrasive table to the rear of the cutting edge flares outwardly, terminating in a side surface parallel to the cutter axis, continuing to the supporting substrate. In a preferred embodiment, the cutter is substantially round in transverse cross-section, and the tapered side surface of the table is a frustoconical surface extending at least partially about the cutter.

46 Claims, 4 Drawing Sheets

U.S. PATENT DOCUMENTS 5,054,246 10/1991 Phaal et al. .
5,103,922 4/1992 Jones .
5,119,714 6/1992 Scott et al. .
5,120,327 6/1992 Dennis .
5,127,923 7/1992 Bunting et al. .
5,135,061 8/1992 Newton, Jr. .
5,154,245 10/1992 Waldenström et al. .
5,159,857 11/1992 Jurewicz .
5,161,627 11/1992 Burkett .
5,173,090 12/1992 Scott et al. .
5,199,512 4/1993 Curlett .
5,238,074 8/1993 Tibbitts et al. .
5,248,006 9/1993 Scott et al. .
5,264,283 11/1993 Waldenström et al. .
5,273,125 12/1993 Jurewicz .
5,279,375 1/1994 Tibbitts et al. .
5,287,936 2/1994 Grimes et al. ..... 175/331
5,291,957 3/1994 Curlett .
5,301,762 4/1994 Besson .
5,314,033 5/1994 Tibbitts .
5,316,095 5/1994 Tibbitts .
5,332,051 7/1994 Knowlton .
5,335,738 8/1994 Waldenström et al. .
5,337,844 8/1994 Tibbitts .
5,346,026 9/1994 Pessier et al. .
5,351,772 10/1994 Smith .
5,355,969 10/1994 Hardy et al. .
5,370,717 12/1994 Lloyd et al. .
5,379,853 1/1995 Lockwood et al. .
5,379,854 1/1995 Dennis .
5,433,280 7/1995 Smith .
5,435,403 7/1995 Tibbitts .
5,437,343 8/1995 Cooley et al. .
5,443,565 8/1995 Strange, Jr. .
5,447,208 9/1995 Lund et al. .
5,460,233 10/1995 Meany et al. .
5,467,836 11/1995 Grimes et al. .
5,499,688 3/1996 Dennis .
5,706,906 1/1998 Jurewicz et al. ..... 175/428

SUPERABRASIVE DRILL BIT CUTTING ELEMENT WITH BUTTRESS-SUPPORTED PLANAR CHAMFER

BACKGROUND OF THE INVENTION

1. Field of the Invention

This invention relates to devices used in drilling and boring through subterranean formations. More particularly, this invention relates to a polycrystalline diamond or other superabrasive cutting element intended to be installed on a drill bit, core bit or other tool used for earth or rock boring, such as may occur in the drilling or enlarging of an oil, gas, geothermal or other subterranean borehole, and to bits and tools so equipped.

2. State of the Art

There are three types of bits which are generally used to drill through subterranean formations. These bit types are: (a) percussion bits (also called impact bits); (b) rolling cone bits, including tri-cone bits; and (c) drag bits or fixed-cutter rotary bits, the majority of which currently employ diamond or other superabrasive cutting elements or "cutters," polycrystalline diamond compact (PDC) cutters being most prevalent.

In addition, there are other structures employed downhole, generically termed "tools" herein, which are employed to cut or enlarge a borehole or which may employ fixed superabrasive cutters on the surface thereof to engage the formation being penetrated. Such tools might include, merely by way of example, core bits, eccentric bits, bi-center bits, and reamers using both fixed and movable structures to carry the cutters. There are also fixed-cutter formation cutting tools employed in subterranean mining, such as drills and boring tools.

An exemplary drag bit or fixed-cutter bit is shown in FIG. 1. The drag bit of FIG. 1 is designed to be turned in a clockwise direction (looking downward at a bit being used in a hole, or counterclockwise if looking at the bit from its cutting end as shown in FIG. 1) about its longitudinal axis. The majority of current drag bit designs employ diamond cutters comprising polycrystalline diamond compacts (PDCs) mounted to, and in most cases actually formed on, a substrate, typically of cemented tungsten carbide (WC). State-of-the-art drag bits may achieve an rate of penetration (ROP) ranging from about one to in excess of one thousand feet per hour, depending on weight on bit (WOB), rotary speed, drilling fluid design and circulation rate, formation characteristics, and other factors known to those of ordinary skill in the art. A disadvantage of state-of-the-art PDC drag bits is that they may prematurely wear due to impact failure of the PDC cutters, as such cutters may be damaged very quickly if used in highly stressed or tougher formations composed of limestones, dolomites, anhydrites, cemented sandstones, interbedded formations such as shale with sequences of sandstone, limestone and dolomites, or formations containing hard "stringers." It is expected that the cutter of the invention will have use in the field of drag bits as a cutter on the face of a drag bit, and as a gage cutter or trimmer to maintain the gage, or diameter, of the borehole being drilled.

As noted above, there are additional categories of structures or "tools" employed in boreholes, which tools employ fixed superabrasive elements for cutting purposes, including core bits, eccentric bits, bi-center bits and reamers, the inventive cutter having utility in such downhole tools, as well as in fixed-cutter drilling and boring tools employed in subterranean mining.

It has been known in the art for many years that PDC cutters perform well on drag bits. A PDC cutter typically has a diamond layer or table formed, under ultra-high temperature and pressure conditions, onto a cemented carbide substrate (such as cemented tungsten carbide) containing a metal binder or catalyst such as cobalt. The substrate may be brazed or otherwise joined to an attachment member such as a stud or to a cylindrical backing element to enhance its affixation to the bit face. The cutting element may be mounted to a drill bit either by press-fitting or otherwise locking the stud into a receptacle on a steel-body drag bit, or by brazing the cutter substrate (with or without cylindrical backing) directly into a preformed pocket, socket or other receptacle on the face of a bit body, as on a matrix-type bit formed of WC particles cast in a solidified, usually copper-based, binder as known in the art.

A PDC is normally fabricated by placing a disk-shaped cemented carbide substrate into a container or cartridge with a layer of diamond crystals or grains loaded into the cartridge adjacent one face of the substrate. A number of such cartridges are typically loaded into an ultra-high pressure press. The substrates and adjacent diamond crystal layers are then compressed under ultra-high temperature and pressure conditions. The ultra-high pressure and temperature conditions cause the metal binder from the substrate body to become liquid and sweep from the region behind the substrate face next to the diamond layer through the diamond grains and act as a reactive liquid phase to promote a sintering of the diamond grains to form the polycrystalline diamond structure. As a result, the diamond grains become mutually bonded to form a diamond table over the substrate face, which diamond table is also bonded to the substrate face. The metal binder may remain in the diamond layer within the pores existing between the diamond grains or may be removed and optionally replaced by another material, as known in the art, to form a so-called thermally stable diamond ("TSD"). The binder is removed by leaching or the diamond table is formed in the first instance with silicon, a material having a coefficient of thermal expansion (CTE) similar to that of diamond. Variations of this general process exist in the art, but this detail is provided so that the reader will understand the concept of sintering a diamond layer onto a substrate in order to form a PDC cutter. For more background information concerning processes used to form polycrystalline diamond cutters, the reader is directed to U.S. Pat. No. 3,745,623, issued on Jul. 17, 1973, in the name of Wentorf, Jr. et al.

Prior art PDCs experience durability problems in high load applications. They have an undesirable tendency to crack, spall and break when exposed to hard, tough or highly stressed geologic structures. The durability problems of prior art PDCs are worsened by the dynamic nature of both normal and torsional loading during the drilling process, wherein the bit face moves into and out of contact with the uncut formation material forming the bottom of the wellbore, the loading being further aggravated in some bit designs and in some formations by lateral vibration of the bit and drill string or by so-called bit "whirl."

The diamond table/substrate interface of conventional PDCs is subject to high residual stresses arising from formation of the cutting element, as during cooling, the differing coefficients of thermal expansion of the diamond and substrate material result in thermally-induced stresses. In addition, finite element analysis (FEA) has demonstrated that high tensile stresses exist in a localized region in the outer cylindrical substrate surface and internally in the substrate. Both of these phenomena are deleterious to the life of the cutting element during drilling operations as the stresses, when augmented by stresses attributable to the loading of the cutting element by the formation, may cause spalling, fracture or even delamination of the diamond table from the substrate.

Further, high tangential loading of the cutting edge of the cutting element results in bending stresses on the diamond table, which is relatively weak in tension and will thus fracture easily if not adequately supported against bending. The metal carbide substrate on which the diamond table is formed is typically of inadequate stiffness to provide a desirable degree of such support.

The relatively thin diamond table of a conventional PDC cutter, in combination with the substrate, also provide lower than optimum heat transfer from the cutting edge of the cutting face, and external cooling of the diamond table as by directed drilling fluid flow from nozzles on the bit face is only partially effective in reducing the potential for heat-induced damage.

The relatively rapid wear of conventional, thin diamond tables of PDC cutters also results in rapid formation of a wear flat in the substrate backing the cutting edge, the wear flat reducing the per-unit area loading on the rock, reducing stress thereon in the vicinity of the cutting edge and thus requiring greater weight on bit (WOB) to force the cutters into the rock and maintain rate of penetration (ROP). The wear flat, due to the introduction of the substrate material as a contact surface with the formation, also increases drag or frictional contact between the cutter and the formation due to modification of the coefficient of friction. As one result, frictional heat generation is increased, elevating temperatures in the cutter, while at the same time the presence of the wear flat reduces the opportunity for access by drilling fluid to the immediate rear of the cutting edge of the diamond table.

Others have previously attempted to enhance the durability of conventional PDC cutters. By way of example, the reader is directed to U.S. Patent Re. 32,036 to Dennis (the '036 patent); U.S. Pat. No. 4,592,433 to Dennis (the '433 patent); and U.S. Pat. No. 5,120,327 to Dennis (the '327 patent). In FIG. 5A of the '036 patent, a cutter with a beveled peripheral edge is depicted, and briefly discussed at col. 3, lines 51–54. In FIG. 4 of the '433 patent, a very minor beveling of the peripheral edge of the cutter substrate or blank having grooves of diamond therein is shown (see col. 5, lines 1–2 of the patent for a brief discussion of the bevel). Similarly, in FIGS. 1–6 of the '327 patent, a minor peripheral bevel is shown (see col. 5, lines 40–42 for a brief discussion of the bevel). Such bevels or chamfers were originally designed to protect the cutting edge of the PDC while a stud carrying the cutting element was pressed into a pocket in the bit face. However, it was subsequently recognized that the bevel or chamfer protected the cutting edge from load-induced stress concentrations by providing a small load-bearing area which lowers unit stress during the initial stages of drilling. The cutter loading may otherwise cause chipping or spalling of the diamond layer at an unchamfered cutting edge shortly after a cutter is put into service and before the cutter naturally abrades to a flat surface or "wear flat" at the cutting edge.

It is also known in the art to radius, rather than chamfer, a cutting edge of a PDC cutter, as disclosed in U.S. Pat. No. 5,016,718 to Tandberg. Such radiusing has been demonstrated to provide a load-bearing area similar to that of a small peripheral chamfer on the cutting face.

U.S. Pat. No. 5,351,772 to Smith discloses a PDC cutter having a plurality of internal radial lands to interrupt and redistribute the stress fields at and adjacent the diamond table/substrate interface and provide additional surface area for diamond table/substrate bonding, permitting and promoting the use of a thicker diamond table useful for cutting highly abrasive formations.

U.S. Pat. No. 5,435,403 to Tibbitts discloses a PDC cutter employing a bar-type, laterally-extending stiffening structure adjacent the diamond table to reinforce the table against bending stresses.

For other approaches to enhance cutter wear and durability characteristics, the reader is also referred to U.S. Pat. No. 5,437,343, issued on Aug. 1, 1995, in the name of Cooley et al. (the '343 patent); and U.S. Pat. No. 5,460,233, issued on Oct. 24, 1995, in the name of Meany et al. (the '233 patent). In FIGS. 3 and 5 of the '343 patent, it can be seen that multiple, adjacent chamfers are formed at the periphery of the diamond layer (see col. 4, lines 31–68 and cols. 5–6 in their entirety). In FIG. 2 of the '233 patent, it can be seen that the tungsten carbide substrate backing the superabrasive table is tapered at about 10°–15° to its longitudinal axis to provide some additional support against catastrophic failure of the diamond layer (see col. 5, lines 2–67 and col. 6, lines 1–21 of the '233 patent). See also U.S. Pat. No. 5,443,565, issued on Aug. 22, 1995, in the name of Strange for another disclosure of a multi-chamfered diamond table.

While the foregoing patents achieved some enhancement of cutter durability, there remained a great deal of room for improvement, particularly when it is desired to fabricate a cutter having, as desirable features, a relatively larger and robust diamond volume offering reduced cutter wear characteristics and increased stiffness. Conventional PDCs employ a diamond table on the order of about 0.030 inch thickness. So-called "double-thick" or 0.060 inch thick diamond tables have been attempted, but without great success due to low strength and wear resistance precipitated to some degree by poorly-sintered diamond tables. It has even been proposed to fabricate PDC cutters with still-thicker chamfered diamond tables, as thick as 0.118 inch, as disclosed in U.S. Pat. No. 4,792,001 to Zijsling. However, the inventor is not aware of the actual manufacture of any such cutters as disclosed by Zijsling.

Yet another cutter bearing an extremely thick diamond table known to the inventor has been developed, such cutter comprising a PDC or other compact of other superabrasive table of substantially enhanced thickness and durability. The aforementioned cutter is disclosed and claimed in co-pending U.S. patent application Ser. No. 08/602,076, now U.S. Pat. No. 5,706,906 filed Feb. 15, 1996 and assigned to Baker Hughes Incorporated, the assignee of the present invention. An exemplary embodiment of the cutter of the '076 application (hereinafter the "'076 cutter") is depicted in FIGS. 2*a* through 2*d* of the drawings. The reader is referred to the aforementioned '076 application for a more detailed physical description of the '076 cutter, variations thereof and their characteristics, but some significant aspects of the '076 cutter as regards the present invention are hereinafter set forth.

Reference is made to FIGS. 2*a* through 2*d* which depict an end view, a side view, an enlarged side view and a perspective view, respectively, of an exemplary embodiment of the '076 cutter. The cutter 501 is of a shallow frustoconical configuration and includes a circular diamond layer or table 502 (e.g. polycrystalline diamond) bonded (i.e. sintered) to a cylindrical substrate 503 (e.g. tungsten carbide). The diamond layer 502 is of a thickness "$T_1$." The substrate 503 has a thickness "$T_2$." The diamond layer 502 includes rake land 508 with a rake land angle θ relative to the side wall 506 of the diamond layer 502 (parallel to the longitudinal axis or center line 507 of the cutter 501) and extending forwardly and radially inwardly toward the longitudinal axis 507. The rake land angle θ is defined as the included acute angle between the surface of rake land 508 and the side wall 506 of the diamond layer which, in a cylindrical cutter as shown, is parallel to longitudinal axis 507. The rake land itself is preferably about 0.050 inch wide, measured radially along the surface of the rake land ($W_1$).

Diamond layer 502 also includes a cutting face 513 having a flat central area 511 radially inward of rake land 508, and a cutting edge 509. Between the cutting edge 509 and the substrate 503 resides a portion or depth of the diamond layer referred to as the base layer 510, while the portion or depth between the flat central area 511 of cutting face 513 and the base layer 510 is referred to as the rake land layer 512. The central area 511 of cutting face 513, as depicted in FIGS. 2*a*, 2*b*, 2*c* and 2*d*, is a flat surface oriented perpendicular to longitudinal axis 507.

In the depicted cutter, the thickness $T_1$ of the diamond layer 502 is in the range of 0.070 to 0.150 inch, with a most preferred range of 0.080 to 0.100 inch. The rake angle θ of the rake land 508 as shown is 65° but may, as previously noted, vary. The boundary 515 of the diamond layer and substrate to the rear of the cutting edge lies at least about 0.015 inch longitudinally to the rear of the cutting edge ($T_3$).

An optional cutter feature proposed for the '076 cutter and depicted in broken lines in FIG. 2*a* is the use of a backing cylinder 516 face-bonded to the back of substrate 503.

The '076 cutter has demonstrated, for a given depth of cut and formation material being cut, a substantially enhanced useful life in comparison to prior art PDC cutters due to a greatly reduced tendency to catastrophically spall, chip, crack and break. It has been found that the cutter in PDC form may tend to show some cracks after use, but the small cracks surprisingly do not develop into a catastrophic failure of the diamond table as typically occurs in prior art PDC cutters. This capability, if fully realized, would be particularly useful in a cutter installed on a drag bit to be used on hard rock formations and softer formations with hard rock stringers therein (mixed interbedded formations) which are currently not economically drillable with PDC cutters.

While the '076 cutters with their large rake lands have shown some promise in initial field testing, conclusively proving the durability of the design when compared to other cutters of similar diamond table thickness but without the large rake land, the '076 cutters have also demonstrated some disadvantageous characteristics which impair their usefulness in real-world drilling situations. Specifically, drill bits equipped with the '076 cutters demonstrate a disconcerting tendency, apparently due to the extraordinarily great cutting forces generated by contact of these cutters with a formation being drilled, to overload drilling motors, other bottomhole assembly (BHA) components such as subs and housings, as well as tubular components of the drill string above the BHA.

Further, bits equipped with the '076 cutters often drill significantly slower, that is to say, their rate of penetration (ROP) of the formation is far less than bits equipped with conventional cutters, and also exhibit difficulty in drilling through hard formations for which they would be otherwise ideally suited. It appears that the exterior configuration of these thick diamond table cutters, although contributing to the robust nature of the cutters, may be less than ideal for many drilling situations due to the variable geometry of the arcuate rake land as it contacts the formation and attendant lack of "aggressiveness" in contacting and cutting the formation. It is conceivable, as demonstrated in the cutting of metal with similarly-shaped structures, that in plastic formations the '076 cutter may simply deform the material of the formation face engaged by the cutter, forming a plastic "prow" of rock ahead and flanking the cutter, instead of shearing the material as intended.

Therefore, despite the favorable characteristics exhibited by the '076 cutter, its utility in efficiently cutting the difficult formations for which its demonstrated durability is ideally suited remains, as a practical matter, unrealized over a broad range of formations and drilling conditions. Further, and as noted with regard to the other cutter designs discussed above, there remains a need for a robust superabrasive cutter which will withstand cutting stresses in the difficult formations referenced above, while drilling effectively with, and without damage to, conventional, state-of-the-art bottomhole assemblies and drill strings, and providing commercially viable, consistent ROP.

SUMMARY OF THE INVENTION

The present invention resolves the difficulties experienced with the cutters previously discussed herein, provides a durable, fairly aggressive cutter having more consistent performance over the life of the cutter in comparison to the '076 cutter, is more economical to fabricate than the '076 cutter, and, unlike the '076 cutter, can be employed effectively with conventional bottomhole assemblies and other drill string components.

The cutter of the present invention comprises, in its currently-preferred embodiment, a substantially cylindrical, cemented tungsten carbide substrate of any suitable length, bearing on its leading face a polycrystalline diamond compact, or PDC, superabrasive table, on the order of about 0.070 to 0.120 inch in thickness, measured along the longitudinal axis of the cutter between a leading portion of the cutting face and the diamond/substrate interface behind the cutting edge. In a preferred embodiment, the periphery of the diamond table, at least immediately behind or trailing the cutting edge of the cutting face, is of slightly tapered, preferably frustoconical configuration, angled between about 10° and about 15°, and most preferably about 10°, to the longitudinal axis of the cutter and, in the case of the preferred embodiment, to the sidewall of the cylindrical substrate. The sidewall taper may, as in a preferred embodiment, lie entirely within the diamond table and not extend into the substrate, the diamond table also preferably having at least a nominal, longitudinally-extending, cylindrical sidewall behind the taper. The outer portion of the cutting face of the cutter, as the cutter is mounted on a bit or tool for cutting a formation, comprises a substantially flat or planar buttress plane or engagement surface angled between about 2° and about 20°, and preferably about 10°, to the remainder of the cutting face, which is oriented perpendicular to the longitudinal axis of the cutter. Viewed from another perspective, and in contemplation that the remainder of the cutting face may not always necessarily be oriented perpendicular to the longitudinal axis of the cutter, the buttress plane or engagement surface may be also said to be placed within a range of angles extending from about 70° to about 88°, and most preferably at about 80°, with respect to the longitudinal cutter axis.

Viewed from the front or leading face of the cutter, as the cutter would be moved during drilling, the engagement surface comprises a linear border or interface with the remainder of the cutting face (assuming the remainder of the cutting face is also planar) and an arcuate border from which the frustoconical sidewall taper of the diamond table extends to the rear. The arcuate border, at least at the apex or initial area of contact with the formation of a new, or "green," cutter, is preferably provided with a small chamfer (about 0.010 to about 0.013 inch, measured along the surface of the chamfer), angled at about 45° to the axis of the cutter. Looking at the cutter from the side, the engagement surface of the cutting face and the sidewall taper of the diamond table behind the cutting edge define an included obtuse "buttress" angle, in the preferred embodiment of about 110°. It is this included buttress angle, in combination with the relatively thick diamond table, which is believed to contribute to the robust and durable nature of the cutter.

The substantially planar engagement surface of the cutting face presents a constant, uniformly backraked cutting surface to the formation, unlike the curved, variable geometry exhibited by the '076 cutter. Further, the backrake of the engagement surface remains constant as the cutter wears, again unlike the geometry exhibited by the '076 cutter. Stated another way, for identical angles of the engagement surface of the cutter of the invention and for the "rake land" of the '076 cutter, formation rock that is cut by the engagement surface taken along any vertical, longitudinal section of the cutter according to the invention is cut at the same backrake angle, while only rock cut by the rake land along the vertical longitudinal center section of the '076 cutter will be cut at that angle, due to the curved, frustoconical configuration of the rake land. The off-center backrake angles of the '076 cutter, as presented to the formation, rapidly become much more negative, and thus less aggressive. This condition is further aggravated as the '076 cutter wears and the radial dimension of the rake land and thus its most aggressive area of contact, taken perpendicular to the formation being cut, are reduced.

It is also preferable that the engagement surface of the diamond table be polished to a high degree of smoothness, in accordance with the teachings of commonly-assigned U.S. Pat. No. 5,447,208, and preferably to a mirror finish. The remainder of the cutting face need not be polished and, if left in a normal, substantially rougher state as is conventional with superabrasive cutters, the transition between the polished engagement surface and the relatively rougher remainder of the cutting face will act as a "chip breaker" to cause a cutting or "chip" of rock sheared from the formation to bend and break, facilitating clearing of such debris from the bit. The cutter may also provide a chip-breaking tendency due to the angled interface between the engagement surface and the remainder of the cutting face, resulting in a formation chip moving up the engagement surface to tend to flex or bend backwards or to the rear (with respect to the direction of cutter movement) to conform under differential pressure effects to the rest of the cutting face above the interface.

BRIEF DESCRIPTION OF THE DRAWINGS

The foregoing and other features and advantages of the invention will become apparent to persons of ordinary skill in the art upon reading the specification in conjunction with the accompanying drawings, wherein.

DETAILED DESCRIPTION OF THE PREFERRED EMBODIMENTS

Figure 1:
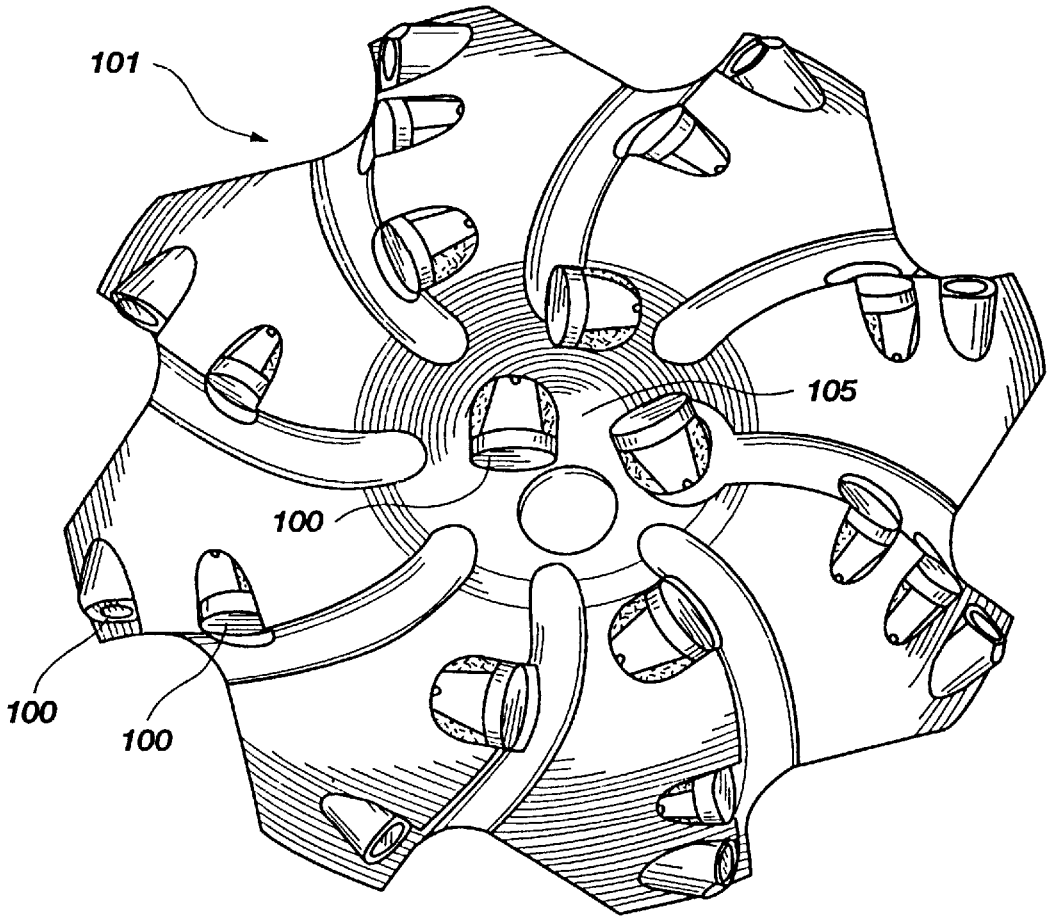
FIG. 1 depicts an exemplary drag bit bearing cutters according to the present invention.
Figure 2A:
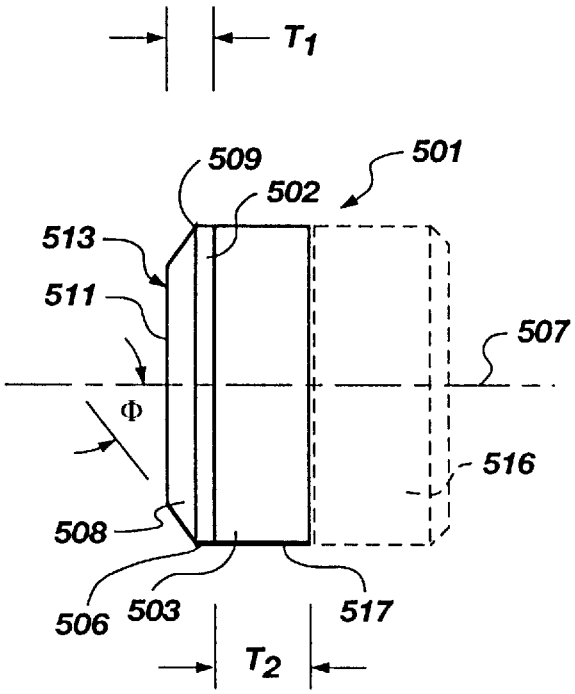
Fig. 2a (PRIOR ART)
FIGS. 2*a* through 2*d* depict an exemplary embodiment of the '076 cutter comprising, respectively, a side view, and enlarged side view of the cutting edge area, a frontal view, and a perspective view.
Figure 2B:
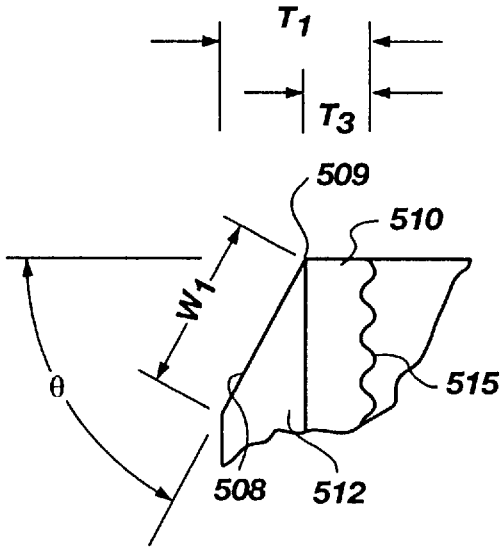
Fig. 2b (PRIOR ART)
Figure 2C:
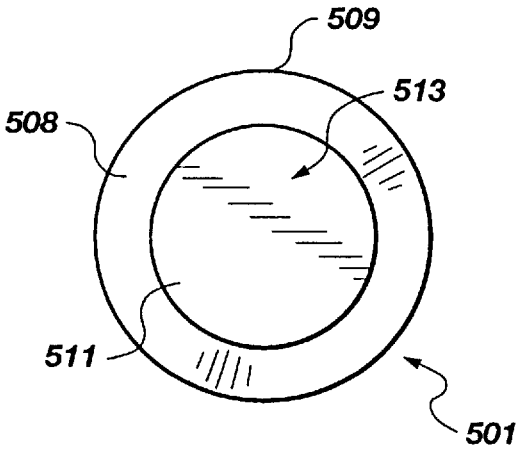
Fig. 2c (PRIOR ART)
Figure 2D:
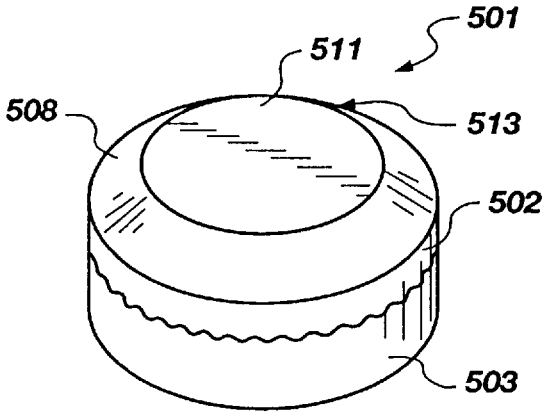
Fig. 2d (PRIOR ART)

Referring to FIG. 1, an exemplary drag bit is illustrated in distal end or face view. The drag bit 101 includes a plurality of cutters 100 according to the present invention, which cutters may be arranged as shown in rows emanating generally radially from approximately the center of the bit 105. The inventor contemplates that the cutter of the invention will primarily be used on drag bits and other fixed-cutter tools for drilling of subterranean formations.

Figure 3:
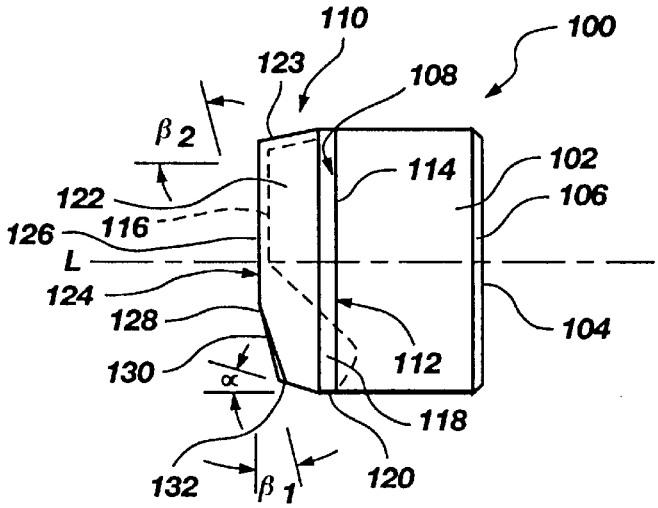
FIG. 3 depicts a side elevation of a preferred embodiment of a cutter according to the present invention.
Figure 4:
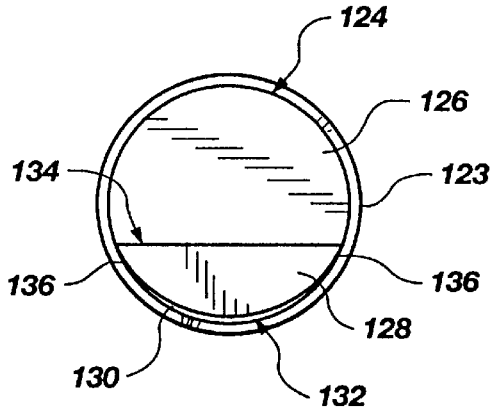
FIG. 4 depicts a frontal elevation of the cutter of FIG. 3.
Figure 5:
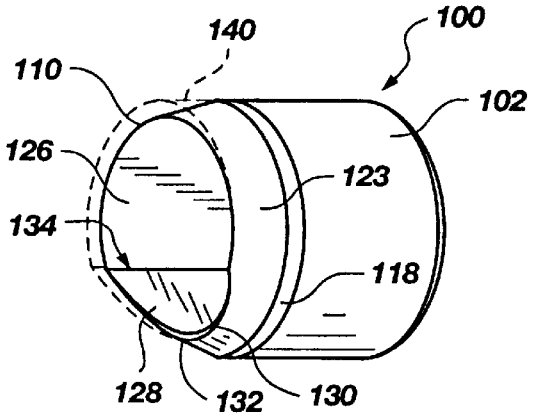
FIG. 5 is a perspective view of the cutter of the present invention.

Referring to FIGS. 3 through 5, an exemplary, preferred embodiment 100 of a cutter in accordance with the present invention will be described. Cutter 100 comprises a substantially cylindrical substrate 102, preferably formed of a cemented carbide such as tungsten carbide. If desired, the trailing end or rear 104 of substrate 102 is bevelled or chamfered as shown at 106. The front or leading face 108 of substrate 102 bears a mass or "table" 110, as such structure is commonly called in the art, of a superabrasive material. The interface 112 between the rear or trailing face 114 of table 110 and the front or leading face 108 of the substrate 102 may be planar as shown, may comprise a series of parallel ridges and valleys, may comprise a plurality of radially extending peaks and interposed valleys, or may be of any other suitable configuration known in the art. Specifically, and in order to conserve superabrasive material, the substrate 102 may extend into table 110 as shown in FIG. 3 in broken lines 116 and, also as shown, the extension may be asymmetrical if desired.

Superabrasive table 110 may comprise a polycrystalline diamond compact, or PDC, a thermally stable PDC, or TSD, or a mass of cubic boron nitride. Other superabrasive materials may also be suitable for this purpose, but currently a PDC is preferred. Table 110 includes a substantially cylindrical trailing segment 118 with sidewall 120 substantially parallel to longitudinal axis L, ahead of which lies a tapered, frustoconical leading segment 122 with sidewall 123 disposed at a small acute angle $\alpha$ to longitudinal axis L (angle $\alpha$ shown with respect to the sidewall of substrate 102, which lies parallel to axis L in the preferred embodiment). A preferred angle is about 10°, although angles in the range of about 10° to about 15° are believed to be suitable. Such a configuration is taught in commonly-assigned U.S. Pat. No. 5,460,233, previously referenced herein. Leading segment 122 terminates at its forward end at cutting face 124 of cutter 100, and at its trailing end at cylindrical trailing segment 118. Cutting face 124 comprises a first surface 126 lying perpendicular to longitudinal axis L, and a second engagement surface or buttress plane 128 lying at a small acute angle $B_1$ with respect to first surface 126, preferably 10° but lying within a range of about 2° to about 20°. Stated another way and in contemplation of first surface 126 being oriented generally transverse but other than perpendicular to longitudinal axis L, second engagement surface 128 is preferably oriented at an angle $B_2$ between about 70° and about 88°, and most preferably at about 80°, with respect to longitudinal axis L. Thus, as best shown in FIG. 3, there is an included, obtuse angle between second engagement surface 128 and sidewall 123 trailing apex 132 of cutting edge 130 at the outer periphery of surface 128, in the preferred embodiment comprising an obtuse angle of about 110°. It is believed that the presence of the obtuse angle, in combination with a relatively thick superabrasive table 110, provide a large portion of the strength of cutter 100. In that vein, it is preferred that the thickness of table 110, measured between first surface 126 and interface 112 lying to the rear of cutting edge 130, be in the range of about 0.070 to about 0.120 inch, measured along longitudinal axis L, and that the leading segment 122 is of about 0.060 to about 0.080 inch thickness, measured in the same way. As noted previously, the depth of table 110 may be non-uniform, and portions of table 110 to the side, top and center of cutter 100 (as viewed in FIG. 3) may be quite shallow without compromising the integrity of table 110 in use. Also as shown in FIG. 3 with broken lines 116, the table 110 may protrude into substrate 102 to provide a greater superabrasive mass behind the most highly-stressed portion of the cutting face 124. As known in the art, cutting edge 130 may be chamfered, at least at the apex 132 of cutting edge 130 which initially engages the formation. As shown in FIGS. 3–5, the chamfer may taper off toward the sides of second engagement surface 128, so that at the lateral ends 136 (see FIG. 4) of cutting edge 130, there is no measurable chamfer.

As viewed from the front (FIG. 4), first surface 126 comprises measurably more than a half-circle, while second surface 128 comprises measurably less, there being a linear, laterally-extending boundary 134 between the two surfaces 126 and 128. Further, as best shown in FIGS. 3 and 4, first surface 126 is about twice the vertical extent of second surface 128. That is to say, for a nominal "half inch" cutter of 0.529 inch diameter, second surface 128 has a height transverse to longitudinal axis L, of about 0.15 inch. It is, however, contemplated that the height so measured for second surface 128 may practically approach one-half of the diameter of the cutter. While the surface 128 could extend even beyond axis L, as a practical matter, cutter 100 might no longer be fixed securely to the bit or tool, and the practice in the industry is to designate a cutter as fully worn when (if it survives to that point) the diamond table and backing substrate is worn to the axis L (also called the centerline).

Figure 6:
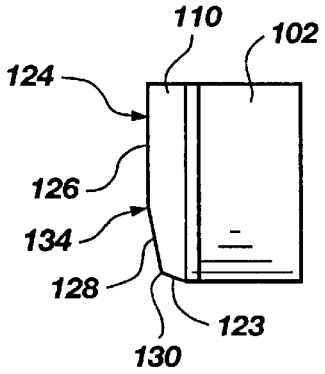
FIGS. 6 and 7 depict, respectively, side and frontal elevations of a tombstone-shaped cutter according to the present invention.
Figure 7:
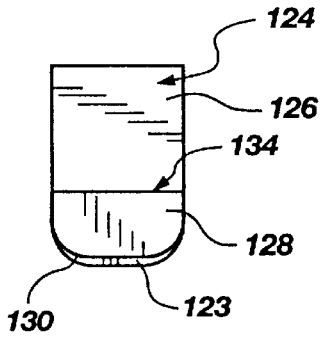
Figure 8:
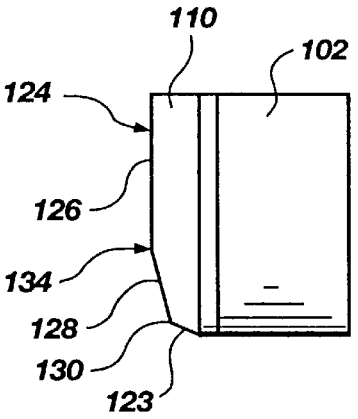
FIGS. 8 and 9 depict, respectively, side and frontal elevations of a rectangular-shaped cutter according to the present invention.
Figure 9:
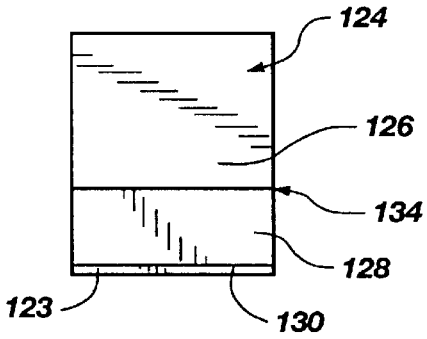

It will be understood that variations of the preferred embodiment may be fabricated while still taking advantage of the inventive design. For example, the tapered segment of table 110 may exist only adjacent cutting edge 130, the remainder of the table sidewall being cylindrical as shown in broken lines 140 in FIG. 5. If desired, the cutter may be configured with a "tombstone" shaped cutting face as known in the art, as viewed from the front, to provide a substantially constant width of cut as the cutter wears. Similarly, the cutting face (as viewed from the front) may be of square or other rectangular shape, the significant aspect of the invention residing in the use of the angled, planar second engagement surface or buttress plane 128 to provide a constant backrake angle, and not in the use of a cutter of cylindrical cross section. Further, a tapered sidewall 123 may be used behind the cutting edge (in this case, a laterally-extending edge due to cutter cross-sectional configuration). FIGS. 6 and 7 depict a tombstone cutter, and FIGS. 8 and 9, one of rectangular configuration. Elements of the cutters depicted in FIGS. 6 through 9 corresponding to those of cutter 100 are denoted by the same reference numerals for clarity.

Figure 10:
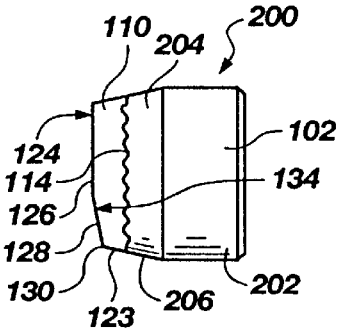
FIGS. 10 through 12 depict, respectively, side elevations of three additional embodiments of a cutter according to the present invention.
Figure 11:
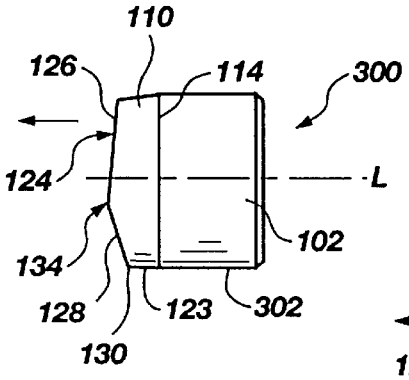
Figure 12:
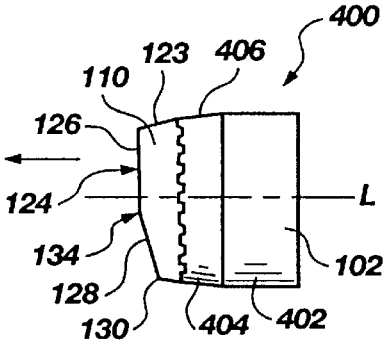

FIGS. 10 through 12 depict additional embodiments of the invention, again corresponding elements of which are identified by the same reference numerals as in the preferred embodiment of FIGS. 3–5.

The cutter 200 of FIG. 10 differs from cutter 100 in that cutter 200 employs a substrate 102 having both a cylindrical trailing portion 202 and a leading portion 204 with a tapered sidewall 206, the taper angle of sidewall 206 being identical to that of sidewall 123 of diamond table 110 and the two sidewalls being contiguous. Further, it should be noted that the cylindrical trailing segment 118 present in cutter 100 has been eliminated. Finally, the interface 114 between diamond table 110 and substrate 102 is of convoluted configuration which may extend, by way of example only, laterally across cutter 200 or radially from a center portion thereof to the side exterior.

The cutter 300 of FIG. 11 differs from cutter 100 in that cylindrical trailing segment 118 of cutter 100 has been eliminated, interface 114 between superabrasive table 110 and substrate 102 lying at the intersection of the trailing edge of tapered sidewall 123 and cylindrical sidewall 302 of substrate 102. Further, the first surface 126 of cutting face 124 does not lie perpendicular to the longitudinal axis of the cutter 300, but "leans" backward (opposite the direction of cutter movement) at a slight angle to the perpendicular to the axis.

The cutter 400 of FIG. 12 differs from cutter 100 in that substrate 102 includes a cylindrical trailing portion 402 and a leading tapered portion 404 with a tapered sidewall 406, the taper of sidewall 406 being of a smaller angle with respect to the longitudinal cutter axis L than the taper of sidewall 123 of superabrasive table 110 (again, cylindrical trailing segment having been eliminated from superabrasive table 110). Further, in this embodiment, first surface 126 of cutting face 124 does itself "lean" slightly forward (in the direction of cutter movement) at a small acute angle to the perpendicular to axis L. Finally, the interface 114 between substrate 102 and diamond table 110 is convoluted, shown as a square-wave interface which may extend, by way of example only, laterally across cutter 400 or radially from the center portion thereof to the side exterior.

Buttress plane or second engagement surface 128, as well as first surface 126 of the cutting faces 124 of the disclosed cutters may be formed to the desired angle during fabrication, or subsequent thereto by mechanical (using superabrasive particles) or electrodischarge grinding or machining, and finished as known in the art by grinding and lapping.

It is also contemplated that the cutter configuration of the present invention possesses utility with a diamond table of conventional thickness, on the nominal order of 0.030 inch, although such utility has yet to be proven. Such cutter might have a diamond table of uniform thickness following the contour of the cutting face, if desired. Similarly, a diamond or cubic boron nitride film cutting face of thin but relatively uniform depth might be applied to a substrate with a leading end configured as a cutting face having a buttress plane or engagement surface in accordance with the present invention.

Further, and as noted above, the second engagement surface or buttress plane 128 is optionally and, preferably, polished in accordance with U.S. Pat. No. 5,447,208, most preferably to a substantially mirror-like finish. Such polishing enhances formation cuttings movement along the cutting face as well as cutting face durability and, again as previously noted, polishing only the buttress plane results in the first surface 126 acting as a chip breaker when a formation cutting or "chip" moving rapidly along the buttress plane suddenly encounters first surface 126 with its substantially higher coefficient of friction.

Finally, the presence of an angled interface between second engagement surface 128 and first surface 126 will tend to break formation chips riding along second engagement surface 128 when they rise above the interface between the two portions of the cutting face, the chip tending to flex or bend backward under differential pressure effects, the different angle of first surface 126 leaving the chip portion passing above the interface unsupported from the rear. This flexing or bending of the chip may be accentuated by using a "backward leaning" first or upper surface 126 on the cutting face 124.

The cutter according to the present invention may be mounted on a drill bit or tool via a stud-type carrier, by brazing or other bonding into a pocket or socket on the face of a bit or tool, or as otherwise known in the art, the manner of mounting the cutter being of no significance to the invention as long as the cutter is adequately secured to withstand drilling forces without breaking free. Further, the effective backrake and siderake angles of the cutter may be adjusted, as known in the art, by the configuration of a mounting stud or of the mounting sockets or pockets for a stud or for receiving the cutter directly. Additionally, the effective backrake of the cutter of the invention is adjustable, along or in combination with variance of the mounting angle to the bit or tool, by varying the angle of the buttress plane.

It is preferred that cutters of the invention be manufactured using the manufacturing process described in the Background section of this application. This includes compressing diamond particles adjacent a suitable substrate material under high pressure and high temperature conditions to form a diamond table that is sintered to the substrate. Of course, if materials other than diamond particles are used for the cutter table, or if materials other than a cemented carbide, such as tungsten carbide (WC), are used for the substrate, then the manufacturing process may need to be modified appropriately. The inventor contemplates that numerous substrates other than tungsten carbide may be used to make the invented cutter. Appropriate substrate materials include any cemented metal carbide such as carbides of tungsten (W), niobium (Nb), zirconium (Zr), vanadium (V), tantalum (Ta), titanium (Ti), tungsten Ti) and hafnium (Hf).

While the present invention has been described and illustrated in conjunction with a number of specific embodiments, those skilled in the art will appreciate that variations and modifications may be made without departing from the principles of the invention as herein illustrated, described and claimed. Cutting elements according to one or more of the disclosed embodiments may be employed in combination with cutting elements of the same or other disclosed embodiments, or with conventional cutting elements, in paired or other groupings, including but not limited to side-by-side and leading/trailing combinations of various configurations. Features of different disclosed embodiments may be combined where appropriate. The present invention may be embodied in other specific forms without departing from its spirit or essential characteristics. The described embodiments are to be considered in all respects as only illustrative, and not restrictive. The scope of the invention is, therefore, indicated by the appended claims, rather than by the foregoing description and appended drawings.

What is claimed is:

1. A cutting element for use on an apparatus for drilling subterranean formations, comprising a cutting face of superabrasive material extending in two dimensions generally transverse to a longitudinal axis of said cutting element to an outer periphery, said cutting face including a rearwardly-extending, substantially planar surface disposed at an acute angle to said longitudinal axis and defining a cutting edge along a portion of said outer periphery of said cutting face.

2. The cutting element of claim 1, wherein said cutting face further includes another surface adjacent said rearwardly-extending, substantially planar surface.

3. The cutting element of claim 2, wherein said another surface is substantially planar and oriented generally transversely to said longitudinal axis.

4. The cutting element of claim 2, wherein said another surface and said rearwardly-extending, substantially planar surface are contiguous, with a linear common boundary.

5. The cutting element of claim 4, wherein said another surface is of greater surface roughness than that of said substantially planar, rearwardly-extending surface.

6. The cutting element of claim 1, further including a sidewall of superabrasive material extending rearwardly from said cutting edge.

7. The cutting element of claim 6, wherein at least a portion of said sidewall is tapered to flare peripherally outwardly to a rear of said cutting edge.

8. The cutting element of claim 7, wherein said cutting face and said sidewall are formed on an exterior of a table comprising a mass of superabrasive material.

9. The cutting element of claim 8, wherein said mass of superabrasive material is mounted on a supporting substrate.

10. The cutting element of claim 9, wherein said cutting face is smaller in cross-sectional area than said substrate, and said tapered sidewall portion flares outwardly from said cutting edge to meet a contiguous sidewall of said substrate.

11. The cutting element of claim 10, wherein said substrate is of substantially cylindrical cross-section, and said tapered sidewall portion comprises a substantially frustoconical sidewall extending from a periphery of said cutting face to a diameter substantially the same as that of said cylindrical substrate.

12. The cutting element of claim 11, further comprising a substantially cylindrical sidewall on said superabrasive table interposed between said frustoconical sidewall and said cylindrical substrate.

13. The cutting element of claim 10, wherein said substrate includes a tapered sidewall portion flaring further outwardly from said tapered table sidewall portion.

14. The cutting element of claim 13, wherein said table and said substrate tapered sidewall portions are tapered at the same angle.

15. The cutting element of claim 13, wherein said table tapered sidewall portion lies at a greater angle to said longitudinal axis than said substrate tapered sidewall portion.

16. The cutting element of claim 9, wherein said table is of a depth of at least about 0.070 inch, measured parallel to said longitudinal axis from a leading end of said cutting face to an interface between said mass of superabrasive material and said supporting substrate on an exterior surface of said cutting element behind a trailing portion of said cutting edge.

17. The cutting element of claim 16, wherein said interface extends transversely across said cutting element substantially along a plane.

18. The cutting element of claim 16, wherein said supporting substrate extends into said table forwardly of said interface.

19. The cutting element of claim 16, wherein said table extends into said supporting substrate rearwardly of said interface.

20. The cutting element of claim 7, wherein said tapered sidewall portion lies at an angle to said longitudinal axis of between about 10° and about 15°.

21. The cutting element of claim 1, wherein at least a portion of said cutting edge is chamfered.

22. The cutting element of claim 1, wherein at least a portion of said substantially planar, rearwardly-extending surface is polished to a substantial mirror finish.

23. The cutting element of claim 1, wherein said acute angle is in a range between about 70° and about 88°.

24. An apparatus for drilling a subterranean formation, comprising:

a body having associated therewith structure for securing said apparatus to a drill string;

at least one cutting element carried by said body, said cutting element including a cutting face of superabrasive material extending in two dimensions generally transverse to a longitudinal axis of said cutting element to an outer periphery, said cutting face including a rearwardly-extending, substantially planar surface disposed at an acute angle to said longitudinal axis and defining a cutting edge along a portion of said outer periphery of said cutting face.

25. The apparatus of claim 24, wherein said cutting face further includes another surface adjacent said rearwardly-extending, substantially planar surface.

26. The apparatus of claim 25, wherein said another surface is substantially planar and oriented generally transversely to said longitudinal axis.

27. The apparatus of claim 25, wherein said another surface and said rearwardly-extending, substantially planar surface are contiguous, with a linear common boundary.

28. The apparatus of claim 27, wherein said another surface is of greater surface roughness than that of said substantially planar, rearwardly-extending surface.

29. The apparatus of claim 24, further including a sidewall of superabrasive material extending rearwardly from said cutting edge.

30. The apparatus of claim 29, wherein at least a portion of said sidewall is tapered to flare peripherally outwardly to a rear of said cutting edge.

31. The apparatus of claim 30, wherein said cutting face and said sidewall are formed on an exterior of a table comprising a mass of superabrasive material.

32. The apparatus of claim 31, wherein said mass of superabrasive material is mounted on a supporting substrate.

33. The apparatus of claim 32, wherein said cutting face is smaller in cross-sectional area than said substrate, and said tapered sidewall portion flares outwardly from said cutting edge to meet a contiguous sidewall of said substrate.

34. The apparatus of claim 33, wherein said substrate is of substantially cylindrical cross-section, and said tapered sidewall portion comprises a substantially frustoconical sidewall extending from a periphery of said cutting face to a diameter substantially the same as that of said cylindrical substrate.

35. The apparatus of claim 34, further comprising a substantially cylindrical sidewall on said superabrasive table interposed between said frustoconical sidewall and said cylindrical substrate.

36. The apparatus of claim 33, wherein said substrate includes a tapered sidewall portion flaring further outwardly from said tapered table sidewall portion.

37. The apparatus of claim 36, wherein said table and said substrate tapered sidewall portions are tapered at the same angle.

38. The apparatus of claim 36, wherein said table tapered sidewall portion lies at a greater angle to said longitudinal axis than said substrate tapered sidewall portion.

39. The apparatus of claim 30, wherein said tapered sidewall portion lies at an angle to said longitudinal axis of between about 10° and about 15°.

40. The apparatus of claim 32, wherein said table is of a depth of at least about 0.070 inch, measured parallel to said longitudinal axis from a leading end of said cutting face to an interface between said mass of superabrasive material and said supporting substrate on an exterior surface of said cutting element behind a trailing portion of said cutting edge.

41. The apparatus of claim 40, wherein said interface extends transversely across said cutting element substantially along a plane.

42. The apparatus of claim 40, wherein said supporting substrate extends into said table forwardly of said interface.

43. The apparatus of claim 40, wherein said table extends into said supporting substrate rearwardly of said interface.

44. The apparatus of claim 24, wherein at least a portion of said cutting edge is chamfered.

45. The apparatus of claim 24, wherein at least a portion of said substantially planar, rearwardly-extending surface is polished to a substantial mirror finish.

46. The apparatus of claim 24, wherein said acute angle is in a range between about 70° and about 88°.

* * * * *